United States Patent [19]

Reif et al.

[11] Patent Number: 5,034,249

[45] Date of Patent: Jul. 23, 1991

[54] PROCESS FOR HARDENING LAYERS CONTAINING PROTEINACEOUS BINDERS

[75] Inventors: Heinz Reif, Cologne; Prem Lalvani, Leverkusen; Hans Buschmann, Cologne, all of Fed. Rep. of Germany

[73] Assignee: Agfa Gevaert Aktiengesellschaft, Leverkusen, Fed. Rep. of Germany

[21] Appl. No.: 86,977

[22] Filed: Aug. 19, 1987

[30] Foreign Application Priority Data

Aug. 29, 1986 [DE] Fed. Rep. of Germany ..... 3629388

[51] Int. Cl.[5] ..... G03C 1/30; G03C 7/26; B05D 3/10; B05D 1/36

[52] U.S. Cl. ..... 427/338; 427/414; 430/422; 430/423; 430/451; 430/554; 430/621; 430/623

[58] Field of Search ..... 427/338, 414; 430/621, 430/623, 554, 451, 423, 422

[56] References Cited

U.S. PATENT DOCUMENTS

| | | | |
|---|---|---|---|
| 3,880,665 | 4/1975 | Himmelmann | 427/338 |
| 4,043,818 | 8/1977 | Himmelmann et al. | 427/338 |
| 4,047,957 | 9/1977 | De Winter et al. | 427/338 |
| 4,055,427 | 10/1977 | Bergthaller et al. | 427/338 |
| 4,061,499 | 12/1977 | Himmelmann | 427/338 |
| 4,063,952 | 12/1977 | Himmelmann et al. | 427/338 |
| 4,067,741 | 1/1978 | Bergthaller et al. | 427/338 |
| 4,119,464 | 10/1978 | Sauerteig et al. | 427/338 |
| 4,168,172 | 9/1979 | Kataoka et al. | 427/414 |
| 4,265,946 | 5/1981 | Yabe et al. | 427/414 |
| 4,421,847 | 12/1983 | Jung et al. | 427/338 |

*Primary Examiner*—Michael Lusignan
*Assistant Examiner*—Margaret Burke
*Attorney, Agent, or Firm*—Connolly & Hutz

[57] ABSTRACT

Layers containing proteinaceous binders, in particular gelatin layers of the kind used, for example, in photographic recording materials, are hardened by means of an instant hardener by casting a hardening system composed of at least two layers over the layer of binder, the lower of these two layers containing the instant hardener while the upper layer, which may be applied together with or immediately after the lower layer, contains a protein-containing binder but no hardener. The hardened layers have improved surface properties (wet scratch resistance, antifriction properties).

11 Claims, No Drawings

PROCESS FOR HARDENING LAYERS CONTAINING PROTEINACEOUS BINDERS

This invention relates to a process for hardening layers containing proteinaceous binders by means of instant hardeners, especially instant hardeners which activate carboxyl groups.

Layers containing proteinaceous binders are used in numerous technical fields, e.g. as protective coatings on objects or as layers of binder in which reactive substances are dispersed, as, for example, in materials used for analytical or diagnostic purposes or in photographic recording materials. For practical use, such layers must be hardened and numerous hardners have become known for this purpose. These hardeners generally react with free amino, imino or hydroxyl groups in the protein-containing binder to bring about cross-linking of the binder.

The use of slowly reacting hardeners is a disadvantage in that, for example, in photographic recording materials, important properties of the cast layers change in the course of storage. In particular, sensitometric data such as sensitivity, gradation and maximum density are liable to drift slowly and the final properties of the layer or combination of layers may frequently be obtained only after a considerable storage time. This requires a greater amount of testing of the product. It is therefore very desirable to use quick acting hardeners as these hardeners acquire their final properties shortly after they have been cast so that the storage and waiting time can be shortened and the amount of testing can be reduced. Very useful quick acting hardeners, hereinafter referred to as instant hardeners, have been described in DE-A-2 225 230, DE-A-2 317 677 and DE-A-2 439 551.

Instant hardeners are compounds which crosslink the binder so that immediately after coating, at the latest after 24 hours, preferably after 8 hours crosslinking is finished so far that no further changing of sensitometric properties and of swelling of the layer arrangement caused by the crosslinking occurs. Swelling is the difference between the thickness of the wet layer and of dry layer during aqueous processing of the film (Photogr. Sci. Eng. 8 (1964), 275; Photogr. Sci. Eng. 16 (1972), 449).

These hardeners which react very rapidly with gelatine are e.g. carbamoyl pyridinium salts which are presumably capable of activating the free carboxyl groups of the proteinaceous binder so that the carboxyl groups can react with free amino groups to form peptide bonds and bring about cross-linking of the binder. Owing to this rapid action, the aforesaid instant hardeners generally should only be added to the gelatine-containing casting solutions shortly before casting because otherwise a premature reaction would take place which would rapidly and irreversibly affect the casting properties, in particular the viscosity of the casting solutions. The instant hardener is generally added to the uppermost layer (protective layer). It enters by diffusion into the other gelatine-containing layers which are to be hardened and effects such rapid cross-linking of the gelatine in these layers that hardening is virtually completed by the time the layers have dried and the parameters which are characteristic for the physical and photographic properties have reached their final use.

The use of instant hardeners is, however, also associated with disadvantages due to the fact that the instant hardener, which is present in considerable excess in the casting solution, reacts with the gelatine even before it is cast so that a proportion of the gelatine molecules undergo intracatenary cross-linking and the gelatine loses its capacity to gel and therefore remains mainly in the sol form even after drying under optimum conditions. It is well known that the sol form increases the fragility of the layer and reduces its scratch resistance. In addition, a protective layer in which a substantial proportion of the gelatine is present in the sol form tends to stick, especially under tropical conditions. In a modern motordriven camera, for example, this may cause functional failure by blocking the transport of the film.

It is a function of the present invention to provide an improved process for hardening layers containing proteinaceous binders by means of instant hardeners.

The invention relates to a process for hardening layers containing proteinaceous binders in which an instant hardener, especially a hardener capable of activating carboxyl groups is applied to the layers to be hardened, characterised in that a first layer containing the hardener is applied to the layer to be hardened and at least one additional layer which contains a protein type binder but is substantially free from hardener is applied at the same time or immediately thereafter.

According to the present invention, hardening of the layers of binder is brought about by coating the layers with an at least two-layered hardening system in which the hardener is present mainly in one of the two partial layers cast on the binder, preferably the lower partial layer while the other partial layer is virtually free from hardener. By this procedure, the layers which are to be hardened, including that partial layer of the hardening system which contains no hardener, are rapidly hardened without intracatenary cross-linking of the binder occurring to any significant extent. The intracatenary cross-linking is normally impossible to avoid completely if the partial layer containing hardener also contains hardenable binder so that a reaction takes place between the binder and the hardener before the partial layer is cast. In practice, the presence of binder can generally not be completely eliminated in the layer containing hardener if uniform application of the hardener is to be ensured. Some advantage is, however, achieved if the intracatenary cross-linking, which is in most cases not completely avoidable, only takes place in one partial layer of the hardening system.

Suitable examples of instant hardeners are compounds of the following general formula

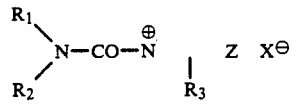

(a)

wherein $R_1$ denotes alkyl, aryl or aralkyl, $R_2$ has the same meaning as $R_1$ or denotes alkylene, arylene, aralkylene or alkaralkylene, wherein the second bond is linked to a group of the formula

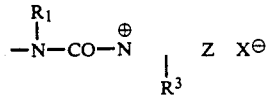

or $R_1$ and $R_2$ together constitute the atoms required for completing an optionally substituted heterocyclic ring such as a piperidine, piperazine or morpholine ring, wherein the ring may be substituted by $C_1$–$C_3$-alkyl or halogen, $R_3$ denotes hydrogen, alkyl, aryl, alkoxy, —$NR_4$—$COR_5$, —$(CH_2)_m$—$NR_8R_9$, —$(CH_2)_n$—$CONR_{13}R_{14}$ or $$-(CH_2)_p-\underset{\underset{R_{15}}{|}}{CH}-Y-R_{16}$$

or a linking group or a direct bond to a polymer chain, $R_4$, $R_5$, $R_6$, $R_7$, $R_9$, $R_{14}$, $R_{15}$, $R_{17}$, $R_{18}$ and $R_{19}$ denote hydrogen or $C_1$–$C_4$-alkyl, $R_5$ denotes hydrogen, $C_1$–$C_4$-alkyl or $NR_6R_7$, $R_8$ denotes —$COR_{10}$, $R_{10}$ denotes $NR_{11}R_{12}$, $R_{11}$ denotes $C_1$–$C_4$-alkyl or aryl, particularly phenyl, $R_{12}$ denotes hydrogen, $C_1$–$C_4$-alkyl, or aryl, particularly phenyl, $R_{13}$ denotes hydrogen, $C_1$–$C_4$-alkyl or aryl, particularly phenyl, $R_{16}$ denotes hydrogen, $C_1$–$C_4$-alkyl, $COR_{18}$ or $CONHR_{19}$, m denotes an integer 1 to 3 n denotes an integer 0 to 3 p denotes an integer 2 to 3 y denotes 0 or $NR_{17}$ or $R_{13}$ and $R_{14}$ together constitute the atoms required for completing an optionally substituted heterocyclic ring such as piperidine, piperazine or morpholine ring, wherein the ring may be substituted by $C_1$–$C_3$-alkyl or halogen, Z constitutes the atoms required for completing an 5- or 6-membered aromatic heterocyclic optionally benzo-condensed ring, and $X^{\ominus}$ denotes an anion which can be absent, if an anionic group is already connected with the molecule;

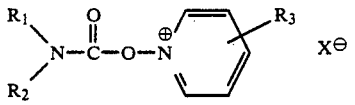

(b)

wherein $R_1$, $R_2$, $R_3$ and $X^{\ominus}$ have the meaning given for formula (a)

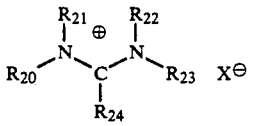

(c)

wherein $R_{20}$, $R_{21}$, $R_{22}$, $R_{23}$ denote $C_1$–$C_{20}$-alkyl, $C_6$–$C_{20}$-aralkyl, $C_5$–$C_{20}$-aryl, unsubstituted or substituted by halogen, sulfo, $C_1$–$C_{20}$-alkoxy, N,N-di-$C_1$–$C_4$-alkyl substituted carbamoyl and, in the case of aralkyl and aryl substituted by $C_1$–$C_{20}$-alkyl, $R_{24}$ denotes a group capable of being spit off by a nucleophilic agent, and $X^{63}$ has the meaning given for formula (a), wherein 2 or 4 of the substituents $R_{20}$, $R_{21}$, $R_{22}$, and $R_{23}$ together with the nitrogen atom or the group $$-N-\overset{\oplus}{\underset{\underset{R_{24}}{|}}{C}}-N-$$

and optionally with further heteroatoms like O or N constitute one or two 5- to 7-membered rings;

$$R_{25}-N=C=N-R_{26} \qquad (d)$$

wherein $R_{25}$ denotes $C_1$–$C_{10}$-alkyl, $C_5$–$C_8$-cycloalkyl, $C_3$–$C_{10}$-alkoxyalkyl or $C_7$–$C_{15}$-aralkyl, $R_{26}$ has the meaning of $R_{25}$ or denotes a group of the formula $$-R_{27}-\overset{\oplus}{\underset{\underset{R_{30}}{|}}{\overset{\overset{R_{28}}{|}}{N}}}-R_{29} \quad X^{\ominus}$$

wherein $R_{27}$ is $C_2$–$C_4$-alkylene, $R_{28}$, $R_{29}$ and $R_{30}$ are $C_1$–$C_6$-alkyl, wherein one of $R_{28}$, $R_{29}$ and $R_{30}$ may be substituted by carbamoyl or sulfo, and two of $R_{28}$, $R_{29}$ and $R_{30}$ together with the nitrogen atom may constitute an optionally substituted heterocyclic ring such as a pyrrolidine, piperazine or morpholine ring which may be substituted by $C_1$–$C_3$-alkyl or halogen, and $X^{\ominus}$ has the same meaning as for formula (a)

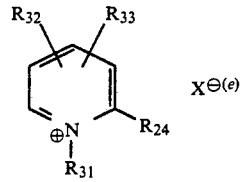

$X^{\ominus(e)}$ wherein $X^{\ominus}$ and $R_{24}$ have the same meaning as in formula (c)

$R_{31}$ denotes $C_1$–$C_{10}$-alkyl, $C_6$–$C_{15}$-aryl or $C_7$–$C_{15}$-aralkyl, unsubstituted or substituted by carbamoyl, sulfamoyl or sulfo, $R_{32}$ and $R_{33}$ denote hydrogen, halogen, acylamino, nitro, carbamoyl, ureido, alkoxy, alkyl, alkenyl, aryl or aralkyl or together the atoms required for a ring condensed with the pyrimidinium ring, particularly a benzo ring, and wherein $R_{24}$ and $R_{31}$ may be connected to each other if $R_{24}$ is a sulfonyloxy group;

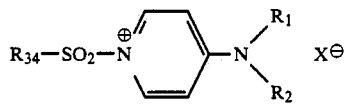

(f)

wherein $R_1$, $R_2$ and $X^{\ominus}$ have the same meaning as for formula (a) and $R_{34}$ denotes $C_1$–$C_{10}$-alkyl, $C_6$–$C_{14}$-aryl or $C_7$–$C_{15}$-aralkyl;

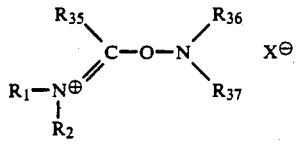

(g)

wherein $R_1$, $R_2$ and $X^{\ominus}$ have the same meaning as for formula (a)

$R_{35}$ denotes hydrogen, alkyl, aralkyl, aryl, alkenyl, $R_{38}O$—, $R_{39}R_{40}N$, $R_{41}R_{42}C{=}N$— or $R_{38}S$—, $R_{36}$ and $R_{37}$ denote alkyl, aralkyl, aryl, alkenyl,

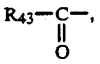

$R_{44}$-$SO_2$ or $R_{45}$—N=N— or together with the nitrogen atom the atoms required for completing a heterocyclic ring or denote the group

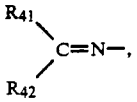

$R_{38}$, $R_{39}$, $R_{40}$, $R_{41}$, $R_{42}$, $R_{43}$, $R_{44}$ and $R_{45}$ denote alkyl, aralkyl, alkenyl, $R_{41}$ and $R_{42}$ additionally hydrogen $R_{39}$ and $R_{40}$ and $R_{41}$ and $R_{42}$ respectively additionally the atoms for completing a 5- or 6-membered, saturated carbocyclic or heterocyclic ring;

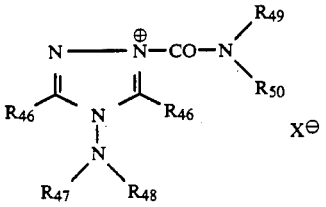

(h)

wherein $R_{46}$ denotes hydrogen, alkyl or aryl $R_{47}$ denotes acyl, carbalkoxy, carbamoyl or aryloxycarbonyl;

$R_{48}$ denotes hydrogen or $R_{47}$ $R_{49}$ and $R_{50}$ denote alkyl, aryl, aralkyl or together with the nitrogen atom the atoms required for completing an optionally substituted heterocyclic ring such as a piperidine, piperazine or morpholine ring which may be substituted by $C_1$–$C_3$-alkyl or halogen, and $X^{\ominus}$ has the same meaning as in formula (a);

$$R_{51}[-SO_2-CH{=}CH_2]_q \quad \text{(i)}$$

wherein $R_{51}$ denotes an optionally substituted heteroaromatic ring with at least q ring carbon atoms and with at least one ring —O—, ring S— or ring—N—atom, and q denotes an integer $\geqq 2$.

The heteroaromatic ring is e.g. a triazole, thiadiazole, oxadiazole, pyridine, pyrole, chinoxaline, thiophene, furan, pyrimidine or triazine ring. Beside the at least two vinylsulfonyl groups the heteroaromatic ring may be substituted further or condensed by a benzo ring which itself may be substituted.

Examples of heterocylic rings $R_{51}$ are:

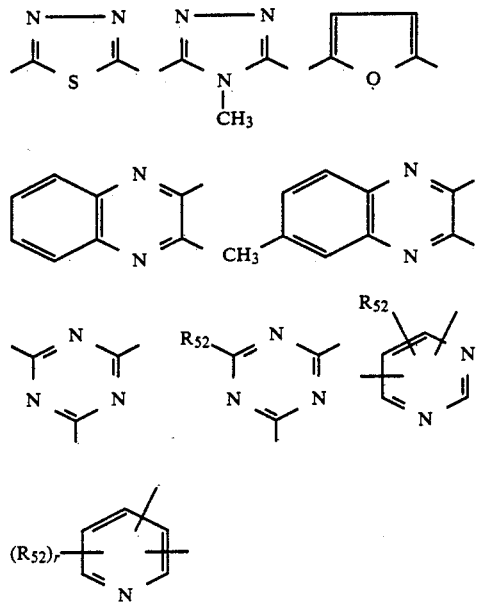

wherein r is a number 0 to 3 and $R_{52}$ denotes $C_1$–$C_4$-alkyl, $C_1$–$C_4$-alkoxy oder phenyl.

Suitable instant hardeners are also those of Japanese laid-open specifications 38540/75, 93470/77, 43 353/81 and 113 929/83 and of U.S. Pat. No. 3,321,313.

Alkyl, if not defined differently, is particularly $C_1$–$C_{20}$-alkyl unsubstituted or substituted by halogen, hydroxy, sulfo and $C_1$–$C_{20}$-alkoxy.

Aryl, if not defined differently, is particularly $C_6$–$C_{14}$-aryl, unsubstituted or substituted by halogen, sulfo, $C_1$–$C_{20}$-alkoxy and $C_1$–$C_{20}$-alkyl. Aralkyl, if not defined differently, is particularly $C_7$–$C_{20}$-aralkyl unsubstituted or substituted by halogen, $C_1$–$C_{20}$-alkoxy, sulfo, and $C_1$–$C_{20}$-alkyl. Alkoxy, if not defined differently, is particularly $C_1$–$C_{20}$-alkoxy.

$X^{\ominus}$ is preferably a halide ion like $Cl^{\ominus}$ or $Br^{\ominus}$, $BF_4^{\ominus}$, $NO_3^{\ominus}$, $(SO_4^{2\ominus})_{\frac{1}{2}}$, $ClO_4^{\ominus}$, $CH_3OSO_3^{\ominus}$, $PF_6^{\ominus}$ and $CF_3SO_3^{\ominus}$.

Alkenyl is particularly $C_2$–$C_{20}$-alkenyl. Alkylene is particularly $C_2$–$C_{20}$-alkylene; arylene is particularly phenylene; aralkylene is particularly benzylene and alkaralkylene is particularly xylylene.

Suitable nitrogen containing ring systems for the definitions of Z are shown on the previous page. The pyridine ring is preferred.

Preferably $R_{36}$ and $R_{37}$ together with the nitrogen atom to which they are bound, denote a pyrrolidine or pyiperidine ring which is preferably substituted in ortho- and ortho-position by oxo-groups and may be condensed with a benzo, cyclohexeno or [2.2.1]-bicyclohexeno ring.

Acyl is particularly $C_1$–$C_{10}$-alkylcarbonyl or benzoyl; carbalkoxy is particularly $C_1$–$C_{10}$-alkoxycarbonyl; carbamoyl is particularly mono- br -di-$C_1$–$C_4$-alkylaminocarbonyl; carbaroxy is particularly phenoxycarbonyl.

Groups $R_{24}$ capable of being split off by nucleophilic agents are such as halogen atoms, $C_1$–$C_{15}$-alkylsulfonyloxy groups, $C_7$–$C_{15}$-aralkylsulfonyloxy groups, $C_6$–$C_{15}$-arylsulfonyloxy groups and 1-pyridinyl groups.
Preferred instant hardeners are:
1
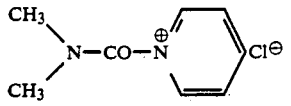
syrup, very hygroscopic
2
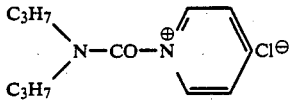
syrup, very hygroscopic
3
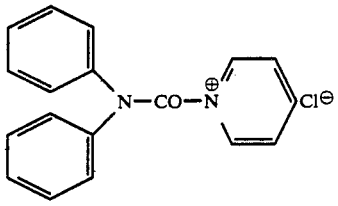
Fp. 112° C.
4
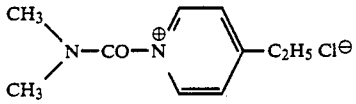
Fp. 103° C.
5
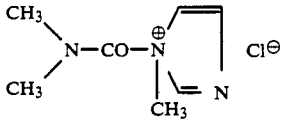
Fp. 87–89° C.
6
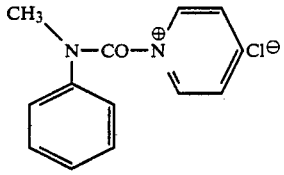
Fp. 108–110° C.
7
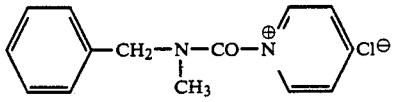
syrup, hygroscopic
8
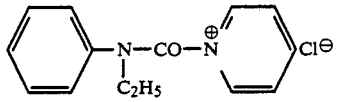
Fp. 105–107° C.
9
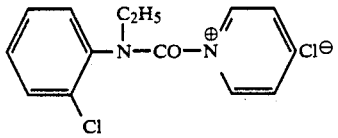
syrup
-continued
10
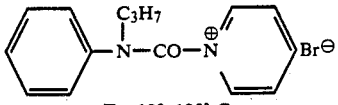
Fp. 103–105° C.
11
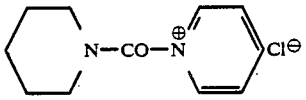
Fp. 75–77° C.
12
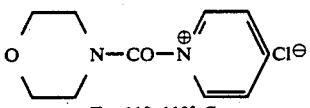
Fp. 110–112° C.
13
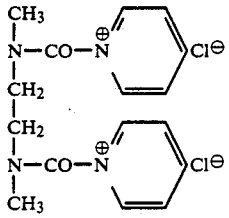
Fp. 95–96° C.
14
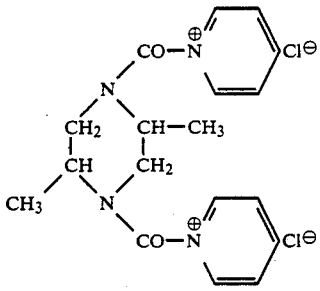
Fp. 106° C.
15
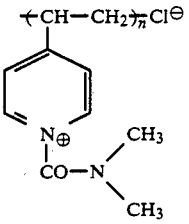
molecular weight more than 10000
16
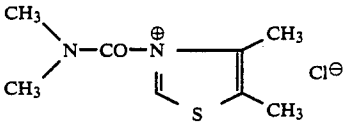
Fp. 66–68° C.
17
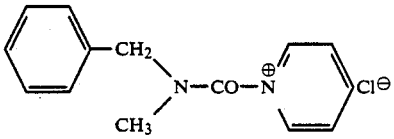
18
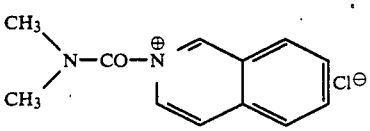

-continued
Oil
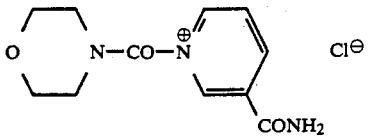
Fp. 103–105° C.
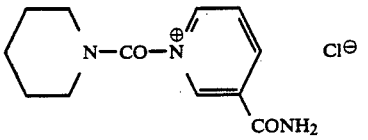
Oil
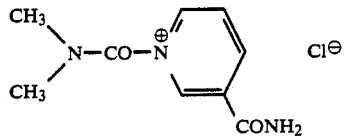
Fp. 109° C.
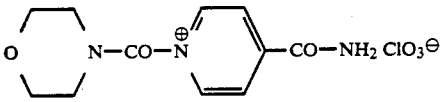
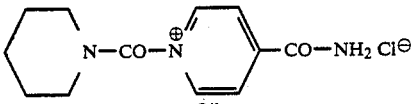
Oil
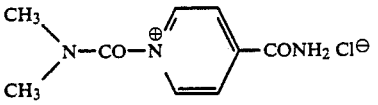
Fp. 115° C.
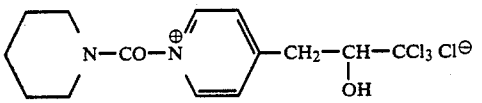
Fp. 154° C.
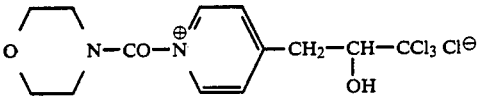
Fp. 140° C.
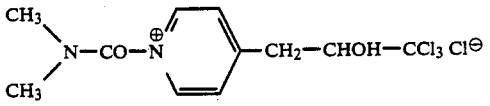
Fp. 115° C.
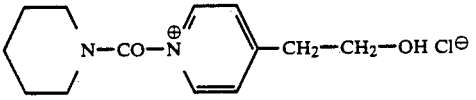
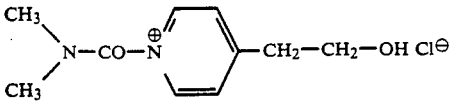
Fp. 140° C.
-continued
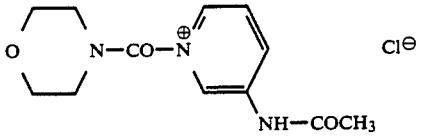
Fp. 118–120° C.
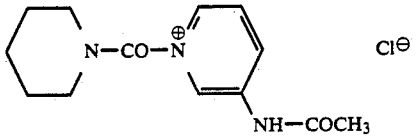
Fp. 90° C.
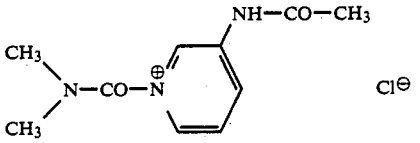
Fp. 210° C.
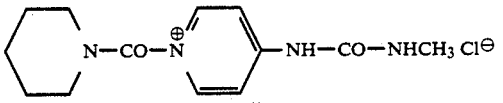
Oil
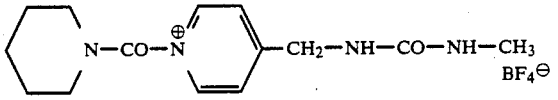
Oil
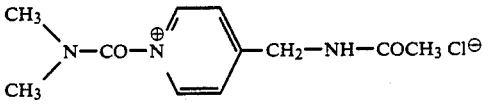
Oil
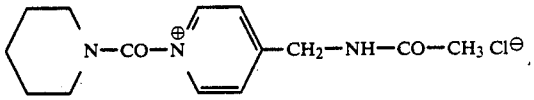
Oil
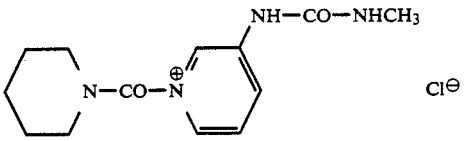
Fp. 60–65° C.
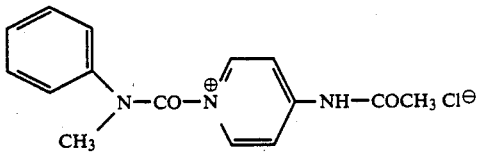
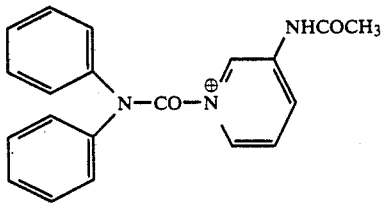

-continued
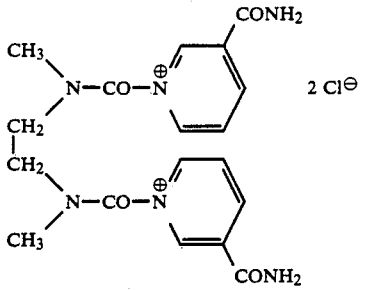
2 Cl⊖
41
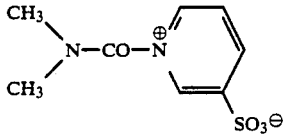
42
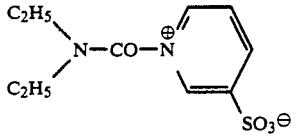
43
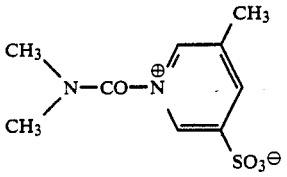
44
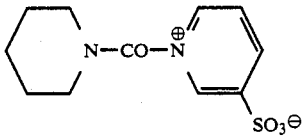
45
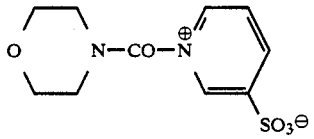
46
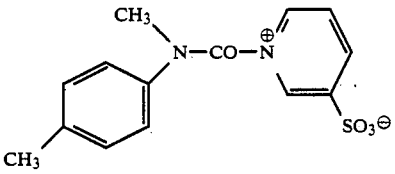
47
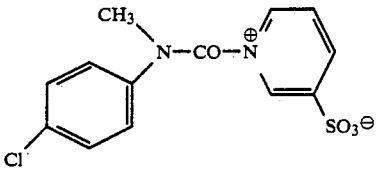
48
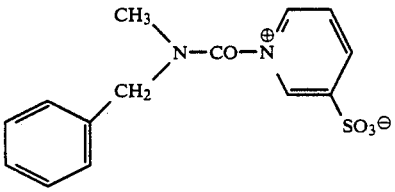
-continued
49
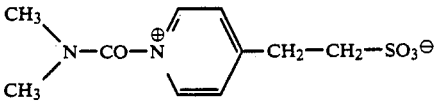
50
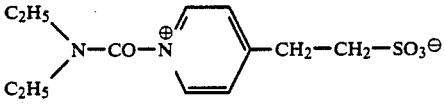
51
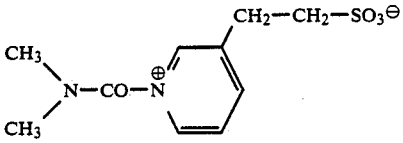
52
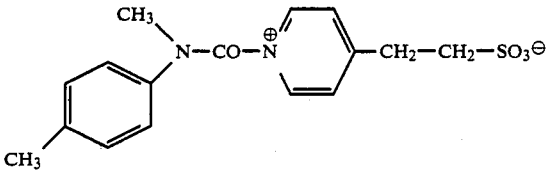
53
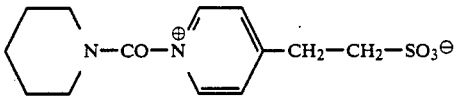
54
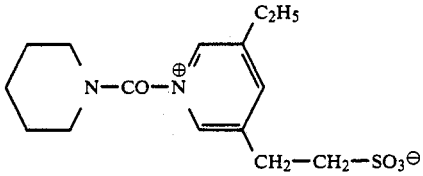
55
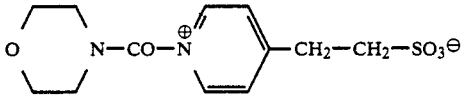
56
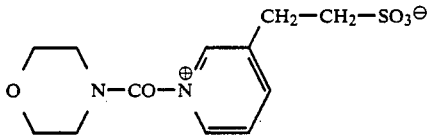
57
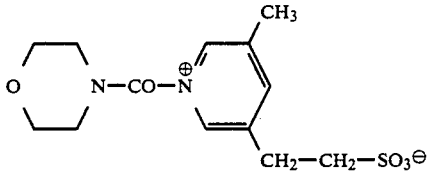
58
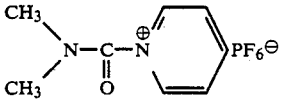
59
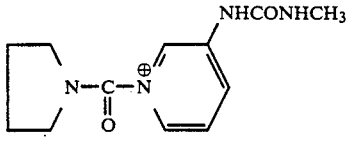
Cl⊖

-continued

60 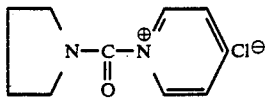

61 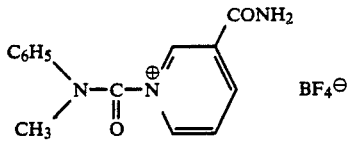

62 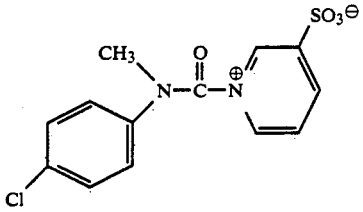

63 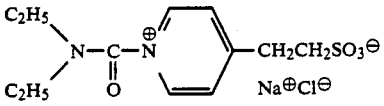

64 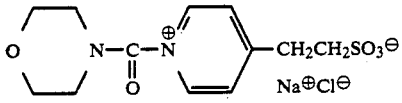

65 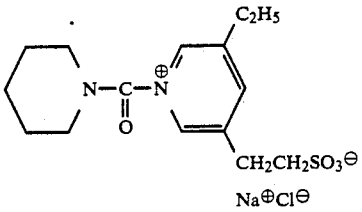

The compounds can be prepared according to methods described in the art. E.g. carbaminic acid chlorides are prepared from secondary amines and phosgene and reacted with aromatic heterocyclic nitrogen containing compounds under exclusion of light. The preparation of compound 3 is disclosed in Chemische Berichte 40, (1907) page 1831. Further methods for the synthesis are in German Offenlegungsschriften 2 225 230, 2 317 677 and 2 439 551.

COMPOUNDS OF FORMULA (b)

A process for the production of these compounds is disclosed in DE 2 408 814

66 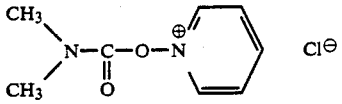

67 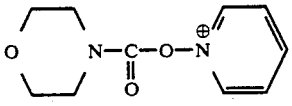

68 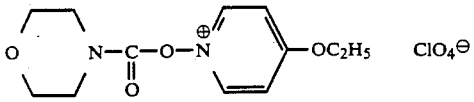

-continued

69 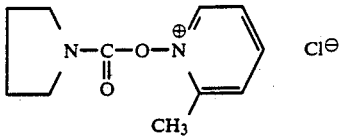

70 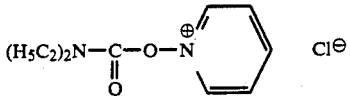

COMPOUNDS OF FORMULA (c)

Methods for the preparation of these compounds are described in Chemistry Letters (The Chemical Society of Japan), pages 1891–1894 (1982). Further methods are in EP-A-162 308.

71 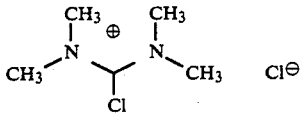

72 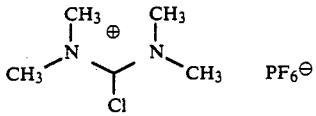

73 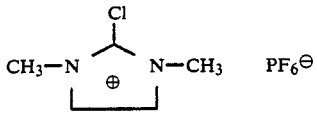

74 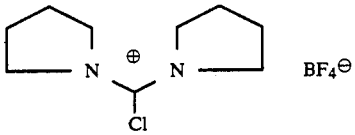

75 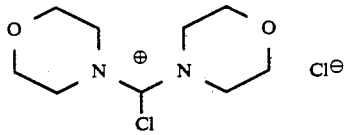

76 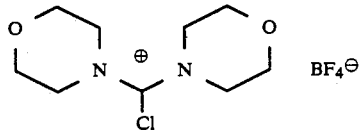

77 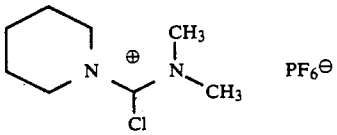

78 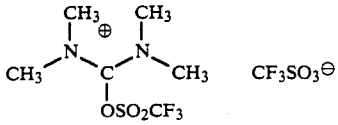

COMPOUNDS OF THE FORMULA (d)

Methods for the synthesis of these compounds are disclosed in JP-laid-open specifications 126 125/76 and 48 311/77.

79

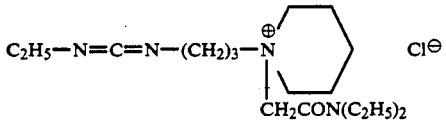

80

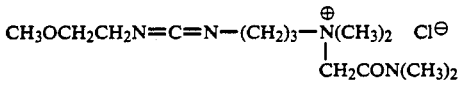

81

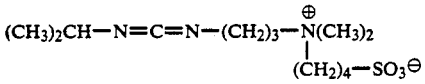

82

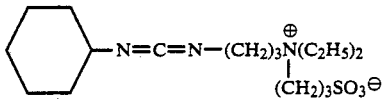

83

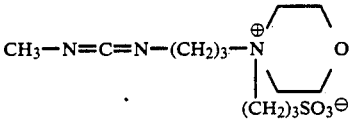

84

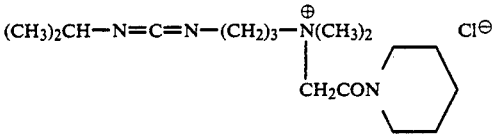

85

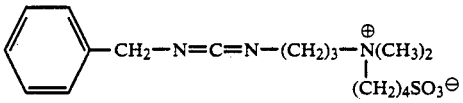

COMPOUNDS OF THE FORMULA (e)

Japanese laid-open specifications 44 140/82 and 46 538/82 and Japanese Patent publication JP-PS 50 669/83 disclose methods of the synthesis of these compounds.

86

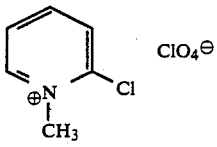

87

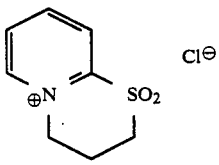

-continued

88

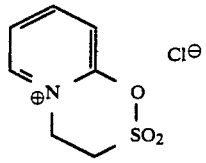

89

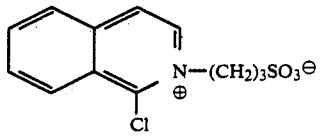

90

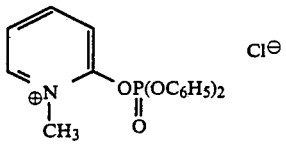

91

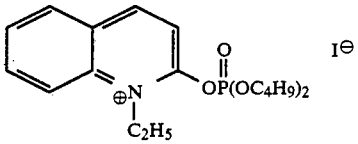

COMPOUNDS OF FORMULA (f)

Japanese Laid-open specification JP-OS 54 427/77 shows a method for the preparation.

92

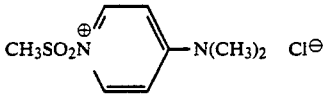

93

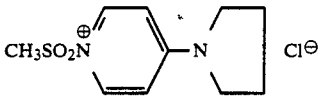

94

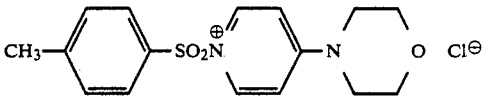

COMPOUNDS OF THE FORMULA (g)

U.S. Pat. No. 4,612,280 shows the preparation of these compounds

95

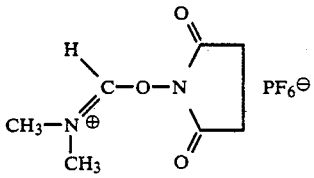

96

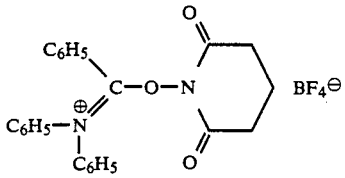

-continued
97
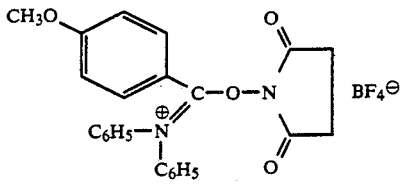
98
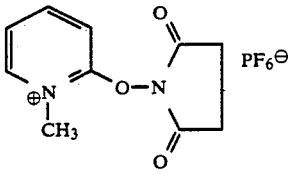
99
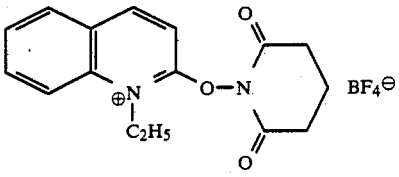
100
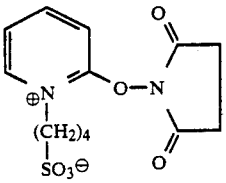
101
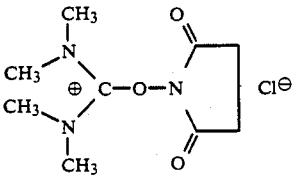
102
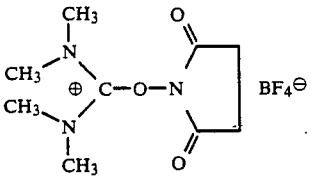
103
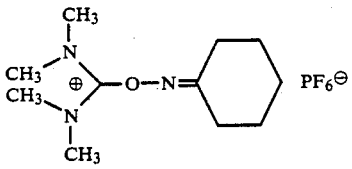
104
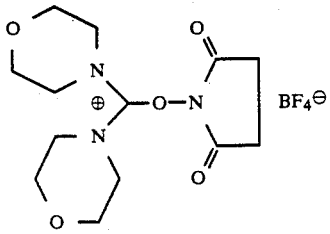
-continued
105
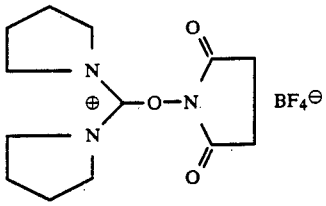
106
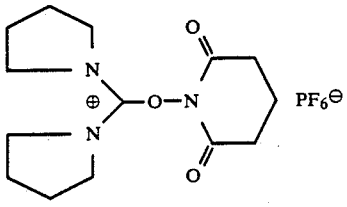
107
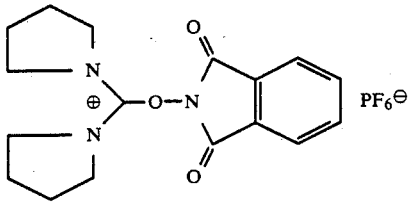
108
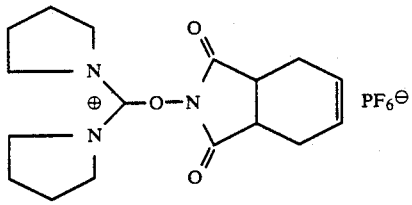
109
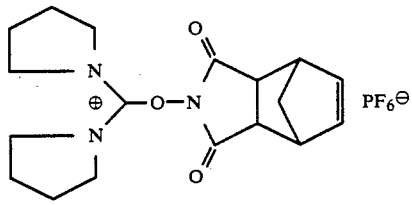
110
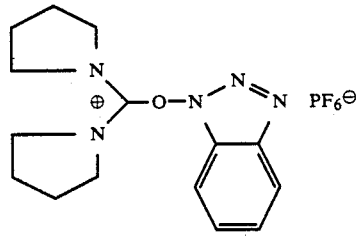
111
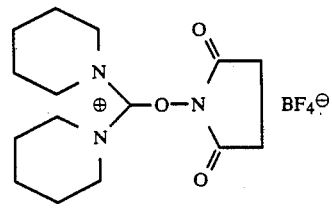

-continued
112
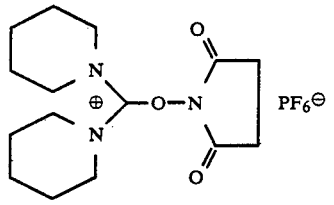
113
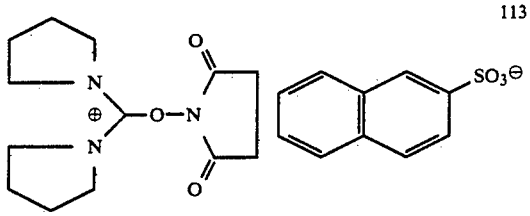
114
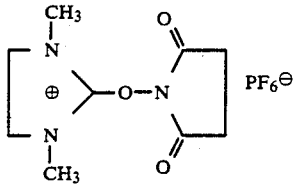
115
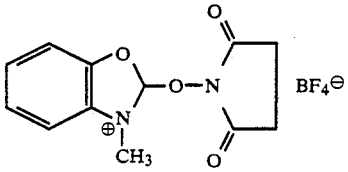
116
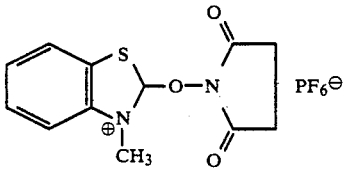
117
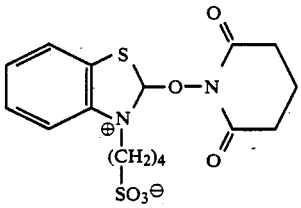
COMPOUNDS OF THE FORMULA (h)
DD 232 564 shows the preparation of the compounds.
118
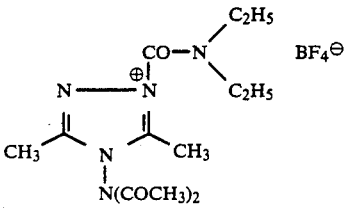
-continued
119
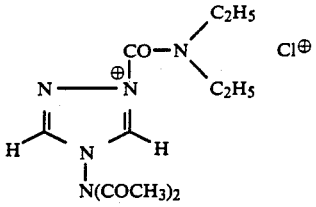
120
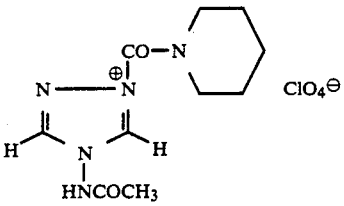
121
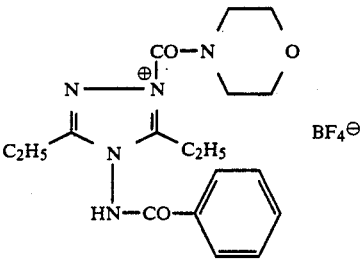
122
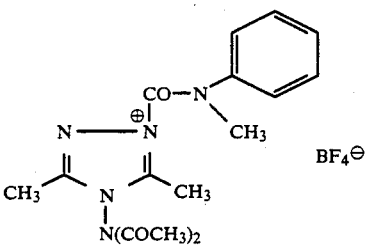
123
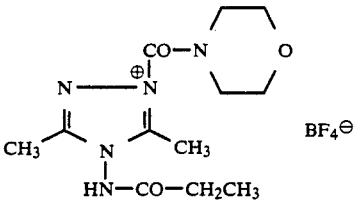
COMPOUNDS OF THE FORMULA (i)
Methods for the preparation of these compounds are described in DE-OS 35 23 360.
124
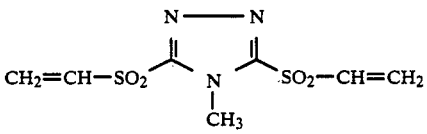
125
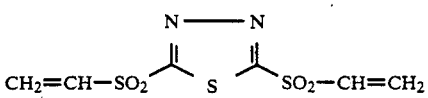

-continued

126

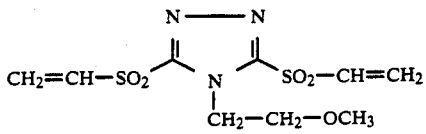

127

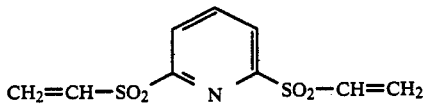

Further suitable instant hardeners correspond to the following formulas

128

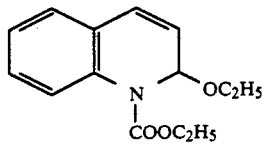

129

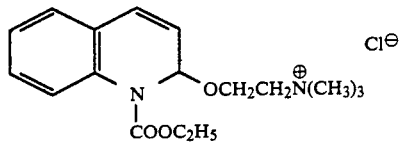

130

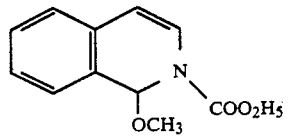

(JP-OS 38 540/75)

131

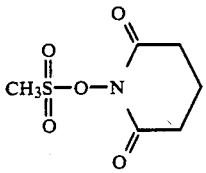

132

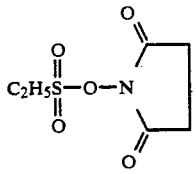

(JP-OS 93 470/77)

133

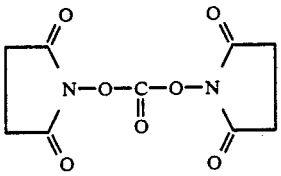

134

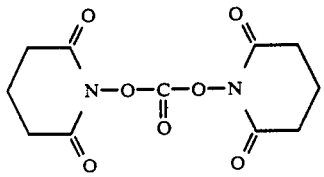

-continued

135

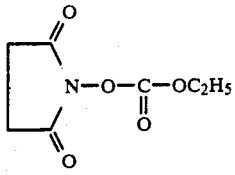

(JP-OS 43 353/81)

136

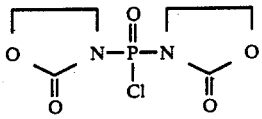

137

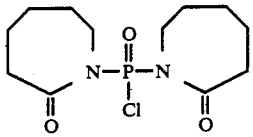

(JP 113 929/83)

138

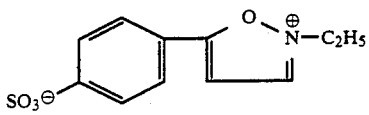

139

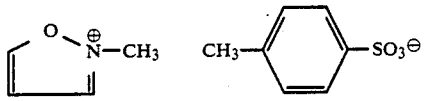

140

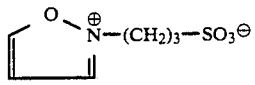

141

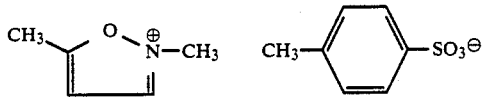

142

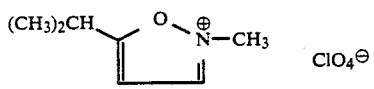

143

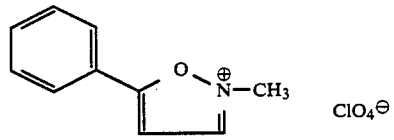

144

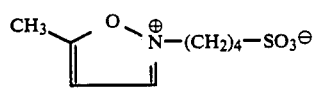

(US-PS 3 321 313)

The compounds of formula (a) are preferred.

The binder which is to be hardened in the layers subjected to the hardening process according to the invention is a proteinaceous binder containing free amino groups and free carboxyl groups. Gelatine is a preferred example. In photographic recording materials, gelatine is the main binder used for light-sensitive substances, colour producing compounds and optionally other additives. Such recording materials frequently have a large number of different layers. In the process of hardening with instant hardeners an excess of hardener is applied as the last layer to the layers which are to be hardened. This layer containing hardener may in addition contain other substances such as UV absorbents, antistatic agents, matting agents and polymeric organic particles.

In the process according to the invention at least one other layer consisting of a binder which is free from hardener but may contain additives of the kind normally used in the uppermost protective layer of a photographic recording material is added simultaneously with or immediately after application of the solution which is to form the coating of hardener.

The layers of the hardening system, consisting of layers containing hardener and at least one other layer of binder may be cast simultaneously or in quick succession by means of cascade or curtain casters. The casting temperature may vary within a wide range, e.g. from 45° C. to 5° C., preferably from 38° C. to 18° C. If the quantity of binder used is small, a casting temperature below 25° C. may be employed.

The various substances are preferably so distributed among the different layers of the hardening system that the instant hardener is applied with the lower partial layer of the system and most of the binder is applied with the upper partial layer. The total thickness of the hardening system composed of two or more cast layers may be, for example, in the region of 0.2 to 2.5 μm. Other additives, such as UV absorbents, colour correction dyes, antistatic agents and inorganic or organic solid particles used, for example, as matting agents or spacers, may be added to the outermost partial layer, which is free from hardener, but they may also be present partly or entirely in the lower partial layer of the system, depending on their function. Suitable UV absorbents are described, for example, in U.S. Pat. No. 3,253,921, DE-C-20 36 719 and EP-A-0 057 160.

Examples of inorganic solid particles which may be incorporated in one of the partial layers of the multilayered hardening system according to the invention include silicon dioxide, magnesium dioxide, titanium dioxide and calcium carbonate. Materials of this kind are frequently used to matt the outermost layers of photographic materials and thereby reduce their tackiness. Solid particles of an organic nature, which may be either soluble or insoluble in alkalies, are also suitable for this purpose. Particles of this kind, also known as spacers, are generally used to roughen the surface in order to modify the surface characteristics, in particular their blocking or sliding properties. Polymethylmethacrylate is one example of an alkali insoluble spacer. Alkali soluble spacers are described, for example, in DE-A-3 424 893. Organic polymers in the form of particles containing reactive groups, especially groups capable of reacting with the binder, such as those described in DE-A-3 544 212 may also be added as so-called hardening agents to one or more partial layers of the multilayered hardening system according to the invention.

In the process according to the invention, the multilayered hardening system is cast on the layers of binder which are to be hardened, in particular gelatine layers. The quantity of hardener contained in one partial layer should be sufficient to harden both the layers which have been covered by this partial layer and the partial layer which is free from hardener. In order that the casting solution which is to form the partial layer containing hardener and which contains relatively little binder may have the necessary viscosity for casting, it is advantageous to add thickners such as polystyrene sulphonic acid or hydroxyethylcellulose to this casting solution.

The layers of binder which are to be hardened may contain reagents, in particular colour reagents for analytical or diagnostic purposes, which may be used, for example, for rapidly detecting the presence of certain substances in human or animal body fluids.

The photographic, in particular colour photographic recording materials to which the process of the present invention may advantageously be applied are preferably multi-layered materials containing several silver halide emulsion layers or emulsion layer units differing in their spectral sensitivity. Such emulsion layer units are laminates of two or more silver halide emulsion layers having the same spectral sensitivity. Layers having the same spectral sensitivity need not necessarily be arranged adjacent to one another but may be separated by other layers, in particular by layers having a different spectral sensitivity. The binder in these layers is generally a proteinaceous binder containing free carboxyl groups and free amino groups, preferably gelatine. In addition to the proteinaceous binder, however, this layer may contain up to 50% by weight of non-proteinaceous binders such as polyvinyl alcohol, N-vinylpyrrolidone, polyacrylic acid and derivatives thereof, in particular their copolymers or cellulose derivatives.

Each of the above-mentioned light-sensitive silver halide emulsion layers or emulsion layer units in the colour photographic recording materials is associated with at least one colour producing compound, generally a colour coupler, which is capable of reacting with colour developer oxidation products to form a non-diffusible or temporarily or locally restricted diffusible dye. The colour couplers are preferably non-diffusible and accommodated either in the light-sensitive layer itself or in close vicinity thereto. The colour couplers associated with the two or more partial layers of an emulsion layer unit need not be identical, provided only that they produce the same colour on colour development, normally a colour which is complementary to the colour of the light to which the light-sensitive silver halide emulsion layers are sensitive.

The red-sensitive silver halide emulsion layers are therefore associated with at least one non-diffusible colour coupler for producing the cyan partial colour image, generally a coupler of the phenol or α-naphthol series. Particularly important examples of these colour couplers are the cyan couplers of the kind described in U.S. Pat. No. 2,474,293, U.S. Pat. No. 2,367,531, U.S. Pat. No. 2,895,826, U.S. Pat. No. 3,772,002, EP-A-0 028 099 and EP-A-0 112 514.

The green-sensitive silver halide emulsion layers are generally associated with at least one non-diffusible colour coupler for producing the magenta partial colour image, usually a colour coupler of the 5-pyrazolone or the indazolone series. Cyanoacetyl compounds, oxazolones and pyrazoloazoles may also be used as magenta couplers. Particularly important examples are the magenta couplers described in U.S. Pat. No. 2,600,788, U.S. Pat. No. 4,383,027, DE-A-1 547 803, DE-A-1 810 464, DE-A-2 408 665 and DE-A-3 226 163.

The blue-sensitive silver halide emulsion layers are normally associated with at least one non-diffusible colour coupler for producing the yellow partial colour image, generally a colour coupler having an open chain ketomethylene group. Particularly important examples are the yellow couplers described in U.S. Pat. No.

3,408,194, U.S. Pat. No. 3,933,501, DE-A-2 329 587 and DE-A-2 456 976.

Many colour couplers of these kinds are known and have been described in numerous Patent Specifications as well as, for example, in the publication entitled "Farbkuppler", by W.Pelz in "Mitteilungen aus den Forschungslaboratorien der Agfa, Leverkusen/Munchen", Volume III (1961) page 111 and the publication by K. Venkataraman in "The Chemistry of Synthetic Dyes", Vol. 4, 341 to 387, Academic Press (1971).

The colour couplers may be 4-equivalent couplers or they may be 2-equivalent couplers. The latter are, of course, derivatives of 4-equivalent couplers in that the coupling position carries a substituent which is split off in the coupling reaction. Some 2-equivalent couplers are virtually colourless while others have an intense colour of their own which disappears in the colour coupling reaction and may be replaced by the colour of the resulting image dye (masking couplers). The known white couplers should in principle be regarded as 2-equivalent couplers although the products obtained from their reaction with colour developer oxidation products are mainly colourless. Also to be included among the 2-equivalent couplers are those couplers which react with the colour developer oxidation products to release from their coupling position a group which develops a particular photographic effect either directly or after one or more further groups have been split off from the group originally released (e.g. DE-A-2 703 145, DE-A-2 855 697, DE-A-3 105 026, DE-A-3 319 428). Such couplers may serve, for example, as development inhibitors or accelerators. Examples of such 2-equivalent couplers include the DIR couplers as well as DAR and FAR couplers.

Suitable DIR couplers have been described, for example, in GB-A-953 454, DE-A-1 800 420, DE-A-2 015 867, DE-A-2 414 006, DE-A-2 842 063 and DE-A-3 427 235.

Suitable DAR couplers and FAR couplers are described, for example, in DE-A-3 209 110, EP-A-0 089 834, EP-A-0 117 511 and EP-A-0 118 087.

Since in the DIR, DAR and FAR couplers it is mainly the activity of the group released in the coupling reaction which is desired and the colour forming properties of these couplers is less important, those DIR, DAR and FAR couplers which mainly give rise to colourless products in the coupling reaction are also important, for example those described in DE-A-1 547 640.

The group released in the reaction may be a ballast group so that the reaction with colour developer oxidation product may result in coupling products, e.g. dyes, which are diffusible or at least have a slight or limited mobility, for example as described in U.S. Pat. No. 4,420,556.

High molecular weight colour couplers have been described, for example, in DE-C-1 297 417, DE-A-2 407 569, DE-A-3 148 125, DE-A-3 217 200, DE-A-3 320 079, DE-A-3 324 932, DE-A-3 331 743, DE-A-3 340 376, EP-A-0 027 284 and US-A-4 080 211. These high molecular weight colour couplers are generally prepared by the polymerisation of ethylenically unsaturated monomeric colour couplers but they may also be obtained by polyaddition or polycondensation reactions.

In addition to the constituents mentioned above, the layers of the colour photographic recording material which are to be hardened by the process according to the invention may contain additives such as anti-oxidants, dye stabilizers and agents for modifying the mechanical and electrostatic properties. The layers to be hardened may also contain compounds which absorb UV light in order to prevent or reduce the adverse effect of UV light on the colour images obtained from the colour photographic recording material according to the invention.

EXAMPLE 1

A colour photographic recording material for colour negative development was prepared by application of the following layers in the given sequence to a transparent layer support of cellulose triacetate. The quantities given are based in each case on 1 $m^2$. The quantity of silver halide applied is given in terms of the corresponding quantity of $AgNO_3$. All the silver halide emulsions were stabilized with 0.5 g of 4-hydroxy-6-methyl-1,3,3a,7-tetraazaindene per 100 g of $AgNO_3$.

Layer 1 (Antihalation layer): Black colloidal silver sol containing 0.5 g of Ag, 0.2 g of octylhydroquinone and 15 g of gelatine.

Layer 2 (Interlayer): 1.0 g of gelatine, 0.05 g of octylhydroquinone.

Layer 3 (1st red-sensitized layer): Red sensitized silver iodobromide emulsion obtained from 3.5 g of $AgNO_3$, with 1.7 g of gelatine and 0.7 g of a mixture of various couplers for producing a cyan partial colour image.*)

*) emulsified with tricresylphosphate in proportions by weight of 1:1.

Layer 4 (2nd red-sensitized layer): Red sensitized silver iodobromide emulsion obtained from 2.0 g of $AgNO_3$ with 2.0 g of gelatine and 0.2 g of a cyan coupler.*)

*) emulsified with tricresylphosphate in proportions by weight of 1:1.

Layer 5 (Interlayer): 0.7 g of gelatine and 0.09 g of 2,5-diisooctylhydroquinone.

Layer 6 (1st green-sensitized layer): green-sensitized silver iodobromide emulsion obtained from 2.2 g of $AgNO_3$ with 1.7 g of gelatine and 0.5 g of a mixture of several couplers for producing a magenta partial colour image.*)

*) emulsified with tricresylphosphate in proportions by weight of 1:1.

Layer 7 (2nd green-sensitized layer): green-sensitized silver iodobromide emulsion obtained from 1.5 g of $AgNO_3$ with 1.7 g of gelatine and 0.2 g of a magenta coupler.*)

*) emulsified with tricresylphosphate in proportions by weight of 1:1.

Layer 8 (Intermediate layer): 0.5 g of gelatine and 0.06 g of 2,5-diisooctylhydroquinone.

Layer 9 (Yellow filter layer): yellow colloidal silver sol containing 0.1 g of Ag, 0.35 g of gelatine and 0.2 g of Compound WM-1.

Layer 10 (1st Blue-sensitive layer): Silver iodobromide emulsion obtained from 0.6 g of $AgNO_3$ with 1.4 g of gelatine and 0.85 g of a mixture of various couplers for producing the yellow partial colour image.*)

*) emulsified with tricresylphosphate in proportions by weight of 1:1.

Layer 11 (2nd Blue-sensitive layer): Silver iodobromide emulsion obtained from 1.0 g of $AgNO_3$ with 0.6 g of gelatine and 0.3 g of the yellow coupler mixture from layer 10.

Layer 12 (UV absorbent layer): 1.5 g of gelatine and 0.8 g of Compound UV-1.

Layer 13 (Interlayer): 0.9 g of gelatine, 0.45 g of Compound WM-1.

The total thickness of all the layers applied was 24.3 μm.

The above-described arrangement of layers (layers 1—13) was hardened by a coating of the following layers:

Material 1 (According to the Invention)

Layer 14 (Hardening layer): 0.150 g of gelatine, 0.024 g of Compound VI-1, 0.700 g of the hardener 55.

Layer 15 (Protective layer): 0.17 g of gelatine, 0.025 g of Compound VI-1, 0.150 g of Compound HM-1, 0.150 g of hydroxypropyl methyl cellulose hexahydrophthalate, 0.065 g of dimethylpolysiloxane.

Material 2 (According to the Invention)

Similar to Material 1 but containing the following

Layer 15 (Protective layer): 0.170 g of gelatine, 0.025 g of Compound VI-1, 0.152 g of polymethyl methacrylate, 0.150 g of hydroxypropyl methyl cellulose hexahydrophthalate, 0.065 g of dimethylpolysiloxane.

Material 3 (Not According to the Invention)

Layer 14 (Protective hardening layer): 0.200 g of gelatine, 0.150 g of Compound HM-1, 0.150 g of hydroxypropyl methyl cellulose hexahydrophthalate, 0.024 g of Compound VI-1, 0.060 g of dimethylpolysiloxane, 0.700 g of hardener 55.

Material 4 (Not According to the Invention)

Layer 14 (Protective hardening layer): 0.200 g of gelatine, 0.152 g of polymethyl methacrylate, 0.150 g of hydroxypropyl methyl cellulose hexahydrophthalate, 0.025 g of Compound VI-1, 0.063 g of dimethylpolysiloxane, 0.700 g of hardener 55.

The following compounds were used:

WM-1: Commercial aqueous dispersion of an anionically modified polyurethane, Impranil® DLN dispersion (Trade product of BAYER AG, Leverkusen).

UV-1

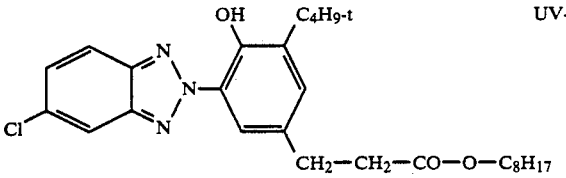

VI-1

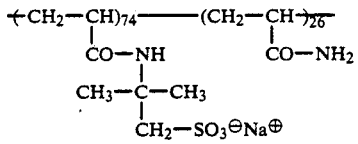

HM-1

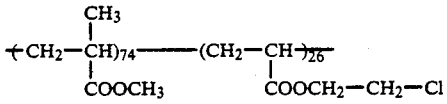

After drying, the wet scratch resistance, the parallel breaking strength, the coefficient of friction and the torque were determined. To determine the wet scratch resistance, a metal tip of specified size was passed over the wet layer and loaded with a weight of increasing magnitude. The wet scratch resistance is defined by the weight [N] at which the tip leaves a visible scratch mark on the layer. A large weight corresponds to a high wet scratch resistance. The measurements were carried out with a sample of material which had previously been left to swell for 5 minutes in water which had a degree of hardness of 10° DH and was at a temperature of 38° C.

The parallel breaking strength was defined by the parameters of breaking diameter [mm] and breaking force [N]. A strip of the given material 35 mm in width which had been perforated along a transverse line was formed into a loop and compressed between two parallel jaws continuously approaching one another. The breaking diameter is the distance between the two jaws and the breaking force is the force with which the two jaws act on the loop at the moment when the loop breaks along the perforation line. The method is described in Research Disclosure 25254 (April 1985).

The coefficient of friction (coefficient of friction = tensile force/perpendicular force × 100) is a measure of the static friction when the material begins to slide with its coated surface over the back of the same material (R/S) or over a surface of V2A steel (V2A/S) under the action of a tensile force.

The winding torque [mN·cm] for forward and backward winding was determined as follows:

The fabricated films were kept in their cartridge for 7 days without covering to acclimatize them to the test atmosphere (35° C., 90% r.H) and then placed in an Orthomat cassette of Leitz and wound forwards by one small film length per second. The torque required for forward winding, from which the friction due to the cassette was subtracted, was taken as a measure for forward winding. Immediately after forward winding was terminated, the film was wound back within 7 s. The torque from the beginning of winding and the maximum torque occurring at the end of winding were measured and used as a measure for back winding.

The results are summarized in Table 1 (see Example 2).

EXAMPLE 2

A colour photographic recording material for reversal colour development was prepared by applying the following layers in the given sequence to a transparent layer support of cellulose triacetate. The quantities given refer in each case to 1 $m^2$. The amount of silver halide applied is given in terms of the corresponding quantities of $AgNO_3$. All the silver halide emulsions were stabilized with 0.5 g of 4-hydroxy-6-methyl-1,3,3a,7-tetraazaindene per 100 g of $AgNO_3$.

Layer 1 (Antihalation layer): Black colloidal silver sol containing 0.5 g of Ag and 1.5 g of gelatine.

Layer 2 (Interlayer): 0.9 g of gelatine, 0.33 g of $AgNO_3$ (micrat), 0.33 g of octyl hydroquinone.

Layer 3 (1st red-sensitized layer): red sensitized silver iodobromide emulsion (5.5 mol-% iodide; mean grain diameter 0.25 μm) obtained from 0.98 g of $AgNO_3$ with 0.81 g of gelatine and 0.26 g of Coupler C - 1.

Layer 4 (2nd red-sensitized layer): red-sensitized silver iodobromide emulsion (6.5 mol-% iodide; mean grain diameter 0.6 μm) obtained from 0.85 g of $AgNO_3$ with 0.7 g of gelatine and 0.58 g of Coupler C-1.

Layer 5 (Interlayer): 1.5 g of gelatine, 0.2 g of octyl hydroquinone, 0.4 g of Compound WM-1.

Layer 6 (1st green-sensitized layer): green-sensitized silver iodobromide emulsion (4.8 mol-% iodide; mean grain diameter 0.28 μm) obtained from 0.94 g of $AgNO_3$ with 0.77 g of gelatine and 0.30 g of Coupler M-1.

Layer 7 (2nd green-sensitized layer): green-sensitized silver iodobromide emulsion (4.3 mol-% iodide; mean grain diameter 0.65 μm) obtained from 0.94 g of $AgNO_3$ with 0.87 g of gelatine and 0.64 g of Coupler M-1.

Layer 8 (Interlayer): 0.6 g of gelatine, 0.15 g of ethylene diurea, 0.08 g of Compound WM-1.

Layer 9 (Yellow filter layer): yellow colloidal silver sol containing 0.2 g of Ag, 0.5 g of gelatine and 0.12 g of Compound WM-1.

Layer 10 (1st blue-sensitive layer): silver iodobromide emulsion (4.9 mol-% iodide; mean grain diameter 0.35 μm) obtained from 0.76 g of $AgNO_3$ with 0.56 g of gelatine, 0.47 g of Coupler Y-1 and 0.4 g of Compound WM-1.

Layer 11 (2nd blue-sensitive layer): silver iodobromide emulsion (3.3 mol-% iodide; mean grain diameter 0.78 μm) obtained from 1.3 g of $AgNO_3$ with 0.76 g of gelatine, 1.42 g of Coupler Y-1 and 0.3 g of Compound WM-1.

Layer 12 (UV absorbent layer): 1.5 g of gelatine, 0.8 g of Compound UV-1.

Layer 13 (Interlayer): 0.9 g of gelatine, 0.4 g of ethylene diurea.

The arrangement of layers described (layers 1–13) was covered with the following layers to harden it:

Material 5 (According to the Invention)

Layer 14 (hardening layer): 0.200 of gelatine, 0.020 g of Compound VI-1, 0.700 g of hardener 55.

Layer 15 (protective layer): 0.200 g of gelatine, 0.020 g of Compound VI-1, 0.150 g of Compound HM-1, 0.150 g of hydroxypropyl methyl cellulose hexahydrophthalate, 0.065 g of dimethyl polysiloxane.

Material 6 (Not According to the Invention)

Layer 14 (Protective hardening layer): 0.300 g of gelatine, 0.150 g of Compound HM-1, 0.100 g of hydroxypropyl methyl cellulose hexahydrophthalate, 0.030 g of Compound VI-1, 0.018 g of dimethyl polysiloxane, 0.700 g of hardener 55.

The following compounds were used:

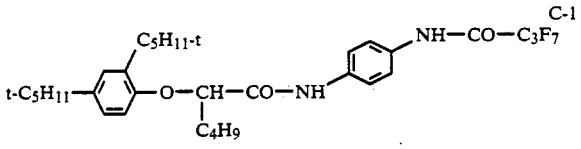

M-1 Coupler 7 from U.S. Pat. No. 12,000,788

Y-1 Coupler 16 from U.S. Pat. No. 13,933,501

The wet scratch resistance, coefficient of friction and winding torque were determined as in Example 1.

The results are shown in Table 1.

TABLE 1

| | Material | Wet scratch resistance [N] | Parallel breaking strength: Breaking diameter [mm] | Parallel breaking strength: Breaking force [N] | Coefficient of friction V2A/S | Coefficient of friction R/S | Torque [mN · cm] V | Torque [mN · cm] R |
|---|---|---|---|---|---|---|---|---|
| Example 1 | 1* | 4.8 | 2.2 | 13 | 210 | 160 | 1700 | 1600→3000 |
| | 3 | 4.6 | 2.5 | 11 | 280 | 170 | 1900 | 2350→3700 |
| | 2* | 4.5 | 2.4 | 12 | 310 | 210 | 1950 | 1850→3300 |
| | 4 | 4.5 | 2.5 | 11 | 300 | 200 | 2050 | 2950→4200 |
| Example 2 | 5* | 5.4 | — | — | 190 | 200 | 2950 | 3350→5900 |
| | 6 | 4.8 | — | — | 220 | 260 | 3000 | 3450→6000 |

*according to the invention

We claim:

1. Process for hardening layers containing proteinaceous binders in which a pourable hardening system containing an instant hardener is cast on the layers to be hardened, characterised in that a first layer containing the instant hardener and at least one other layer containing proteinaceous binder but free from a hardening amount of an instant hardener are applied simultaneously or successively to the layers to be hardened.

2. Process according to claim 1, characterised in that the layers to be hardened are layers of a multi-layered photographic recording material.

3. Process according to claim 2, characterised in that the layers to be hardened are layers of a multi-layered colour photographic material.

4. Process according to one of claims 1, 2 and 3, characterised in that the layers to be hardened are gelatine layers.

5. Process according to one of the claims 1 or 2, characterised in that at least one layer of the multi-layered hardening system contains inorganic or organic solid particles.

6. Process according to claim 1, 2 or 3, characterised in that the layers of the multi-layered hardening system containing the instant hardener also contains at least one viscosity increasing compound.

7. Process according to claim 4, characterised in that the layer of the multi-layered hardening system which is free from hardener is applied to the partial layer containing the instant hardener before the latter layer is dry.

8. Process according to claim 7, characterised in that the layers of the multi-layered hardening system are applied simultaneously to the layers to be hardened.

9. Process according to claim 4, characterised in that a hardener corresponding to the following formula is used:

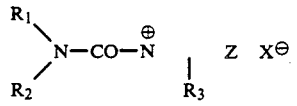

(a)

wherein $R_1$ denotes alkyl, aryl or aralkyl, $R_2$ has the same meaning as $R_1$ or denotes alkylene, arylene, aralkylene or alkaralkylene, wherein the second bond is linked to a group of the formula

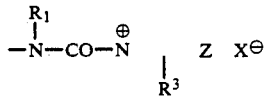

or $R_1$ and $R_2$ together constitute the atoms required for completing an optionally substituted heterocyclic ring such as a piperidine, piperazine or morpholine ring, wherein the ring may be substituted by $C_1$–$C_3$-alkyl or halogen, $R_3$ denotes hydrogen, alkyl, aryl, alkoxy, —$NR_4$—$COR_5$, —$(CH_2)_m$—$NR_8R_9$, —$(CH_2)_n$—$CONR_{13}R_{14}$ or $$-(CH_2)_p-\underset{\underset{R_{15}}{|}}{CH}-Y-R_{16}$$

or a linking group or a direct bond to a polymer chain, $R_4$, $R_5$, $R_6$, $R_7$, $R_9$, $R_{14}$, $R_{15}$, $R_{17}$, $R_{18}$ and $R_{19}$ denote hydrogen or $C_1$–$C_4$-alkyl, $R_5$ denotes hydrogen, $C_1$–$C_4$-alkyl or $NR_6R_7$, $R_8$ denotes —$COR_{10}$, $R_{10}$ denotes $NR_{11}R_{12}$, $R_{11}$ denotes $C_1$–$C_4$-alkyl or aryl, particularly phenyl, $R_{12}$ denotes hydrogen, $C_1$–$C_4$-alkyl or aryl, particularly phenyl, $R_{13}$ denotes hydrogen, $C_1$–$C_4$-alkyl or aryl, particularly phenyl, $R_{16}$ denotes hydrogen, $C_1$–$C_4$-alkyl, $COR_{18}$ or $CONHR_{19}$, m denotes an integer 1 to 3 n denotes an integer 0 to 3 p denotes an integer 2 to 3 y denotes O or $NR_{17}$ or $R_{13}$ and $R_{14}$ together constitute the atoms required for completing an optionally substituted heterocyclic ring such as piperidine, piperazine or morpholine ring, wherein the ring may be substituted by $C_1$–$C_3$-alkyl or halogen, Z constitutes the atoms required for completing an 5- or 6-membered aromatic heterocyclic optionally benzo-condensed ring, and $X^{\ominus}$ denotes an anion which can be absent, if an anionic group is already connected with the molecule.

10. In a process for hardening photographic layers which contain gelatin in multilayer photographic films comprising silver halide emulsion layers which contain gelatin the steps of applying on top of said gelatin containing silver halide emulsion layers a first layer which contains an instant hardener and simultaneously or subsequently carrying out the step of applying to said layers at least one other layer containing proteinaceous binder and being free from a hardening amount of instant hardener.

11. A process as claimed in claim 10 in which the first layer contains at least one viscosity increasing compound.

* * * * *